US008807987B2

(12) United States Patent
Lehman et al.

(10) Patent No.: US 8,807,987 B2
(45) Date of Patent: Aug. 19, 2014

(54) BURNER AND IGNITION ASSEMBLY AND METHOD

(75) Inventors: Lon Lehman, Ft. Wayne, IN (US); Eugene Tippman, Jr., Ft. Wayne, IN (US)

(73) Assignee: Unified Brands, Inc., Jackson, MS (US)

( * ) Notice: Subject to any disclaimer, the term of this patent is extended or adjusted under 35 U.S.C. 154(b) by 332 days.

(21) Appl. No.: 12/617,196

(22) Filed: Nov. 12, 2009

(65) Prior Publication Data

US 2011/0111353 A1 May 12, 2011

(51) Int. Cl.
*F23N 5/20* (2006.01)

(52) U.S. Cl.
USPC ..... 431/6; 431/62; 431/354; 431/355; 126/285 A; 251/340

(58) Field of Classification Search
USPC ..... 431/354, 355, 6, 62; 251/129.15, 340, 251/343
See application file for complete search history.

(56) References Cited

U.S. PATENT DOCUMENTS 1,856,466 A * 5/1932 Conover ..... 74/501.6
1,937,974 A * 12/1933 McKee ..... 236/74 R
2,014,665 A * 9/1935 Palmer ..... 239/424
2,164,417 A * 7/1939 McKee ..... 236/48 R
2,296,792 A * 9/1942 Kester ..... 236/15 R
2,364,299 A * 12/1944 Kester ..... 431/89
2,497,316 A * 2/1950 Logan ..... 261/28
2,627,910 A * 2/1953 Abrams ..... 239/558
2,652,108 A * 9/1953 Jenkins ..... 431/75
2,801,646 A * 8/1957 Funderwhite ..... 137/625.46
2,840,153 A * 6/1958 Campbell et al. ..... 137/607
3,232,592 A * 2/1966 Lohman ..... 432/51
3,307,529 A * 3/1967 Fannon, Jr. et al. ..... 126/92 B
3,905,756 A * 9/1975 Ferlin et al. ..... 431/354
4,114,584 A * 9/1978 Rogerson et al. ..... 123/179.16
4,274,392 A * 6/1981 Myers ..... 126/112
4,375,950 A * 3/1983 Durley, III ..... 431/12
4,465,456 A * 8/1984 Hynek et al. ..... 431/62
4,565,521 A * 1/1986 Hancock ..... 431/75
5,003,943 A * 4/1991 Lafferty, Sr. ..... 123/198 D
5,103,781 A * 4/1992 Scott et al. ..... 123/179.18
5,553,603 A * 9/1996 Barudi et al. ..... 126/512
5,601,073 A * 2/1997 Shimek ..... 126/512
5,660,765 A * 8/1997 King et al. ..... 261/39.3
5,669,373 A * 9/1997 Gulddal ..... 126/112
5,931,661 A * 8/1999 Kingery ..... 431/354
6,206,687 B1 * 3/2001 Redington ..... 431/90
6,378,551 B1 * 4/2002 Long ..... 137/495
6,488,495 B1 * 12/2002 Long et al. ..... 431/258
6,887,073 B1 * 5/2005 Ruffolo ..... 431/159
8,025,048 B1 * 9/2011 Scarborough ..... 126/38
8,303,297 B2 * 11/2012 Tompkins et al. ..... 431/90

(Continued)

FOREIGN PATENT DOCUMENTS

EP 643264 A1 * 3/1995

*Primary Examiner* — Jorge Pereiro
(74) *Attorney, Agent, or Firm* — Butler Snow LLP

(57) ABSTRACT

A burner and ignition assembly, and method include a burner unit, an air intake, and a fuel supply supplying gas and including an air intake. The amount of air entering the air intake can be controlled by momentarily adjusting a choke that is movable relative to the air intake to cover a portion of an opening of the air intake to reduce an amount of air entering the air intake when a cold start condition exists.

18 Claims, 4 Drawing Sheets

(56) References Cited

U.S. PATENT DOCUMENTS

| | | | | |
|---|---|---|---|---|
| 2001/0051321 | A1* | 12/2001 | La Fontaine | 431/12 |
| 2002/0055075 | A1* | 5/2002 | Long | 431/103 |
| 2006/0154194 | A1* | 7/2006 | Panther et al. | 431/354 |
| 2007/0169771 | A1* | 7/2007 | Almasri et al. | 126/512 |
| 2008/0011286 | A1* | 1/2008 | Almasri et al. | 126/502 |
| 2009/0032012 | A1 | 2/2009 | von Herrmann et al. | |
| 2009/0101133 | A1 | 4/2009 | Bortoliero et al. | |
| 2009/0111065 | A1* | 4/2009 | Tompkins et al. | 431/12 |

* cited by examiner

BURNER AND IGNITION ASSEMBLY AND METHOD

FIELD OF THE INVENTION

A burner and ignition assembly, and method of igniting a burner, are disclosed.

BACKGROUND

Burners are used in applications requiring a heat source, such as in cooking and heating systems. A burner typically includes a porous surface, or plate having an array of holes packed in high density. The burner plate can be made of a material that will transmit heat through infrared radiation, such as ceramic or a metal material. During operation, a mixture of gas and air flows through the holes in the burner plate and is ignited at the exiting surface of the ceramic plate. The combustion of the gas-air mixture takes place at the burner plate surface and partially in the pores of the plate. After the gas-air mixture ignites, the burner plate quickly reaches a temperature at which the heat radiates from the plate surface.

Mixing of the air and gas for combustion in a burner can be carried out under atmospheric pressure or at a higher pressure. The ratio of air-to-gas for efficient combustion can be determined according to a type of gas being used in the burner. For instance, the required air-gas ratio for natural gas fuel is about 10:1, the ratio for propane is about 24:1, and the ratio for butane is about 37:1. However, it can be difficult to initially ignite the air-gas mixture and to carry the flame over the surface of the burner plate in an even or uniform manner, especially when the burner is starting from a "cold" state, and especially when using combustible gases having a higher heating value per unit volume than natural gas, such as butane/air, propane/air and propane at reduced pressure.

SUMMARY

In accordance with an aspect consistent with the claimed invention, an improved gas burner and ignition assembly, and method of igniting a burner increase the likelihood that the burner ignites uniformly and reliably.

More particularly, embodiments consistent with the invention relate to a burner assembly including a burner unit and a fuel supply attached to the burner unit and including a gas valve, an air intake, and a mixing portion in which gas and air are mixed. The burner assembly includes a choke movable relative to the air intake to adjust an amount of air entering into the air intake port, and a controller to control the movement of the choke relative to the air intake, wherein the controlled movement includes momentarily moving the choke to a position that reduces an amount of air entering the intake when a cold start condition exists.

In accordance with other embodiments consistent with the invention, a method of igniting a burner includes monitoring for presence of a request for heat, determining if a cold start condition exists when a request for heat is present, and activating a choke that moves relative to an air intake of the burner to restrict an amount of intake air entering the intake and supplying gas to the burner for a momentary time period if a cold start condition exists. An ignition device activates to light the burner after the momentary time period expires, but not during the momentary time period. After the burner ignites, the choke is deactivated and returned to its position prior to activation.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

Figure 1:
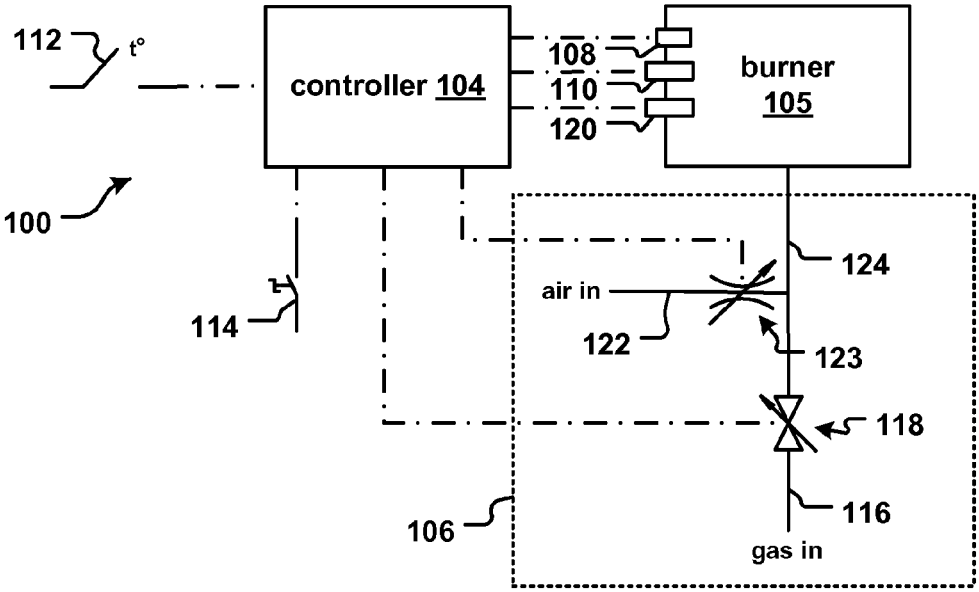
FIG. 1 is a diagram of a naturally aspirated burner system including a blower in accordance with an exemplary embodiment.

The various aspects are described hereafter in greater detail in connection with a number of exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art.

Many aspects of the invention are described in terms of sequences of actions to be performed by elements of a computing system or other electronic hardware capable of executing stored instructions. For example, some embodiments described herein describe a controller that receives information in the form of signals from one or more system elements and provides instructions to system elements to carry out processes consistent with embodiments of the claimed invention. It will be recognized that in each of the embodiments, the various actions could be performed by more than one controller, for example, a microcontroller, by specialized circuits (e.g., discrete logic gates interconnected to perform a specialized function), by program instructions being executed by one or more processors, or by a combination of these things. Moreover, embodiments consistent with the claimed invention can additionally be considered to be embodied entirely within any form of computer readable carrier, such as solid-state memory, magnetic disk, and optical disk containing an appropriate set of computer instructions that would cause a processor to carry out the techniques described herein. Thus, various aspects consistent with the claimed invention may be embodied in many different forms.

Embodiments consistent with the claimed invention are described with reference to block diagrams and/or operational illustrations of methods and program products. It is to be understood that each block of the block diagrams and/or operational illustrations, and combinations of blocks in the block diagrams and/or operational illustrations, can be implemented by radio frequency, analog and/or digital hardware, and/or computer program instructions. These computer program instructions may be provided to a processor circuit of a general purpose computer, special purpose computer, an application specific integrated circuit (ASIC), and/or other programmable data processing apparatus, such that the instructions, which execute via the processor of the computer and/or other programmable data processing apparatus, create mechanisms for implementing the functions/acts specified in the block diagrams and/or operational block or blocks. In some alternative implementations, the functions/acts noted in the blocks may occur out of the order noted in the operational illustrations. For example, two blocks shown in succession may in fact be executed substantially concurrently, at non-consecutive times, or the blocks may sometimes be executed in the reverse order, depending upon the functionality/acts involved.

With reference now to the drawings, FIG. 1 is a diagram showing a burner system 100 according to an embodiment that uses an inspirator type air-gas mixing system. The burner system 100 includes a controller 104 and a burner 105, for example, an infrared burner, and a fuel supply 106. The controller 104 monitors signals received from a temperature sensor 108 and a flame sensor 110 positioned near the burner 105, a value set on a thermostat 112, and a power on/off switch 114. Signal paths between elements of burner system 100 are schematically illustrated as dash/dot lines in FIG. 1. The thermostat 112 can include an interface by which a user can select the desired temperature value, although a thermostat can be set to a predetermined temperature value. The thermostat 112 and power on/off switch 114 can be positioned on a control panel (not shown) or other position accessible by a user of an apparatus including the burner system 100.

Also shown in FIG. 1 is an igniter, or ignition electrode 120 positioned adjacent a surface of the burner 105, such as a porous plate where an air/gas fuel mixture exits the burner 105. The fuel supply 106 of burner system 100 includes a fuel supply line 116, a gas valve 118 (e.g., a gas solenoid, ball or gate valve) to control gas fuel flow in the fuel supply line 116, an air intake 122, an air intake choke 123, and a fuel mixing portion 124 in which air and gas are mixed before the resulting air/gas mixture exits the burner 105. While FIG. 1 shows a single air intake 122 and fuel mixing portion 124, it is to be understood that embodiments can have more than one air intake and/or mixing portion depending on the shape and/or size of the burner surface, the number of burner plates used, the rate or of air/gas to be delivered to the burner, or combinations thereof.

In operation, the controller 104 monitors the status of the signals received from the temperature sensor 108, flame sensor 110, thermostat 112, power off/on switch 114, and controls a flow of gas through the gas fuel line 116 by controlling the gas valve 118, determines whether to activate the ignition electrode 120, and whether to momentarily activate the air choke 123, based on the status of the received signals. More particularly, the controller 104 can determine which ignition processes to perform when request for heat is present. As used herein, "a request for heat" can be an instruction or other indication that the burner should be supplied with, and burn an air/gas. For example, a request for heat can be generated by turning on the power on/off switch 114, a determination that a temperature sensed at the area to be heated by an apparatus including the burner unit, such as a cooking device, space heater, or other heating device, when a temperature area to be heated has fallen below an operating temperature set on the thermostat 112, or a combination of the thermostat 112 and the power on/off switch 114.

In an embodiment, the controller 104 can determine whether to initiate a "cold start" ignition process or a "normal" ignition process after receiving a request for heat. In the cold start ignition process, the controller 104 activates the air intake choke 123 to move it into a prescribed position relative to the intake 122, or a selected one of plural possible positions relative to the intake 122, for a prescribed momentary "pre-flow" period of time that restricts an amount of air entering the air intake 122. Around this time, or coincidentally with movement of the choke to a restricting position, the controller 104 and opens the gas valve 118 to supply a rich air/gas mixture for the predetermined pre-flow period of time before activating the ignition electrode 120 to ignite the rich air/fuel mixture exiting the burner surface. The delay before igniting the burner 105 for a pre-flow period of time allows gas from the valve 116 to accumulate in the body of the burner 105 to provide a substantially uniform distribution of flame at the burner surface after ignition. For example, activation of the ignition electrode 120 can be delayed for 4 to 12 seconds, preferably about 8 to 12 seconds, after a request for heat is received at the controller 104.

During the momentary pre-flow delay, the gas valve 118 is opened to permit fuel under pressure to be discharged from a nozzle or jet located upstream of a fuel mixing portion 124 and upstream the air intake 122. Air intake 122 can include, for example, one or more ports through which air is drawn into the mixing portion 124 by the momentum of the fuel being delivered to the burner 105. At or around the same time, the controller 104 activates the air intake choke 123 to restrict an amount of air that can be drawn in by the air intake 122 and mixed in a mixing portion 124 with gas entering from the gas valve 118 to provide a low air/gas ratio (i.e., fuel-rich) mixture to initially fill the burner body. The pre-flow period can be defined by a timer (not shown) that the controller 104 can start after initiating a cold start ignition process. A timer for such purposes can be a function incorporated in the hardware, firmware and/or software of the controller or provided separately from, and controlled by the controller 104. After the pre-flow period ends, for example, when the counter counts to a predetermined value, the controller 104 activates the ignition electrode 120 to ignite the rich pre-flow air/gas mixture exiting the burner 105, and thereafter deactivates the air intake choke 123 by moving the choke 123 to a position that exposes a greater area, or all of the air intake 122.

Because most cold starts occur after turning on the power on/off switch 114, the controller 104 can determine that a request for heat has been initiated by a cold start if it senses that the switch 114 has been placed in an "on" (i.e., power on") position. For greater certainty of a cold start situation, a temperature sensor 108 can be used to determine whether temperature of the burner 105 is adequate for ignition without activating the air intake choke 123.

The controller 104 initiates the "normal" ignition process if a request for heat occurs when the controller 104 receives a signal from temperature sensor 108 indicating the burner remains hot enough to be ignited safely and uniformly without choking the air intake or delaying activation of the ignition electrode 120. For example, if a request for heat occurs when the burner system 100 is powered up and the thermostat 112 is maintaining an operating temperature by cycling the burner 105 between on and off states, the temperature sensor 108 will likely indicate that temperature at which a normal ignition process can be used to light the burner. Even if the burner 105 is restarted, for example, after a momentary power outage or frequent or repeated resetting of the on/off switch while the burner 105 is operating, the temperature of the burner 105 sensed at temperature sensor 108 can be used by the controller 104 to determine whether to initiate a cold or normal ignition process.

Figure 2:
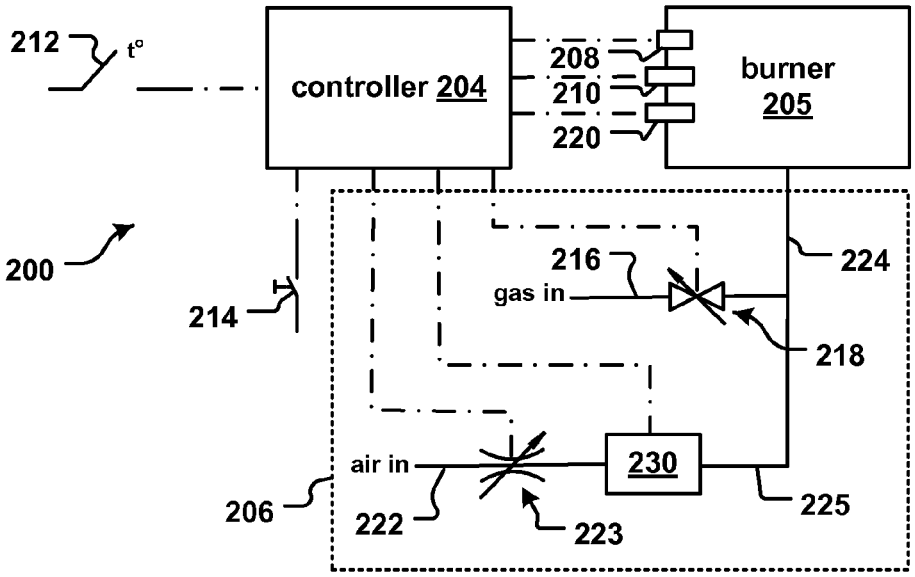
FIG. 2 is a diagram of a forced air burner system in accordance with an exemplary embodiment.

FIG. 2 illustrates burner system 200 according to an embodiment that uses a blower to supply air to a fuel mixture. Like the burner system 100, the burner system 200 includes a controller 204, a burner 205, and a fuel supply 206. The controller 204 monitors signals received from a temperature sensor 208 and a flame sensor 210 positioned near the burner 205, a value set on a thermostat 212, and a power on/off switch 214. The signal paths between the elements of system 200 are schematically illustrated using dashed/dot lines. The thermostat 112 can include an interface by which a user can select the desired temperature value, although a thermostat can be set to a predetermined temperature value. The thermostat 212 and power on/off switch 214 can be positioned on a control panel (not shown) or other position accessible by a user of an apparatus including the burner system 200. The controller 204 monitors signals from a temperature sensor 208, a flame sensor 210, a thermostat 212, and a power on/off switch 214. As described above, the controller 204 can determine whether to initiate a cold start or normal ignition process based on the status of the monitored signals.

As described above with respect to burner system 100, the fuel supply 206 of burner system 200 includes a fuel supply line 216 including a valve 218, an air intake 222, an air intake choke 223, and a fuel mixing portion 224 in which air and gas are mixed before the exiting the burner 205. However, the fuel supply 206 includes a blower 230 to force air into a channel 225 and draw a gas from valve 218, which can be under pressure or at atmospheric pressure. During the pre-flow period, the controller 204 momentarily activates the choke 223 located upstream from the intake of the blower 230 by moving it to one or more positions that to restrict an amount of air the blower 230 can draw and thereafter mixed in the mixing portion 224 with gas from the gas valve 218. As a result, the air/gas ratio of the mixture entering the burner can be lowered to provide a rich fuel mixture to the burner 205 during the momentary pre-flow period. The pre-flow period is a delay before ignition to provide substantially uniform gas-rich mixture at the outlets of the burner, which is ignited by activating the ignition electrode 220. After the gas-rich mixture ignites, the controller 204 receives a signal from the flame sensor 210 indicating the presence of a flame, which causes the controller 204 to deactivate the air intake choke 223 and move the choke 223 to a position that exposes or uncovers a greater portion, or all of the intake 222.

Figure 3:
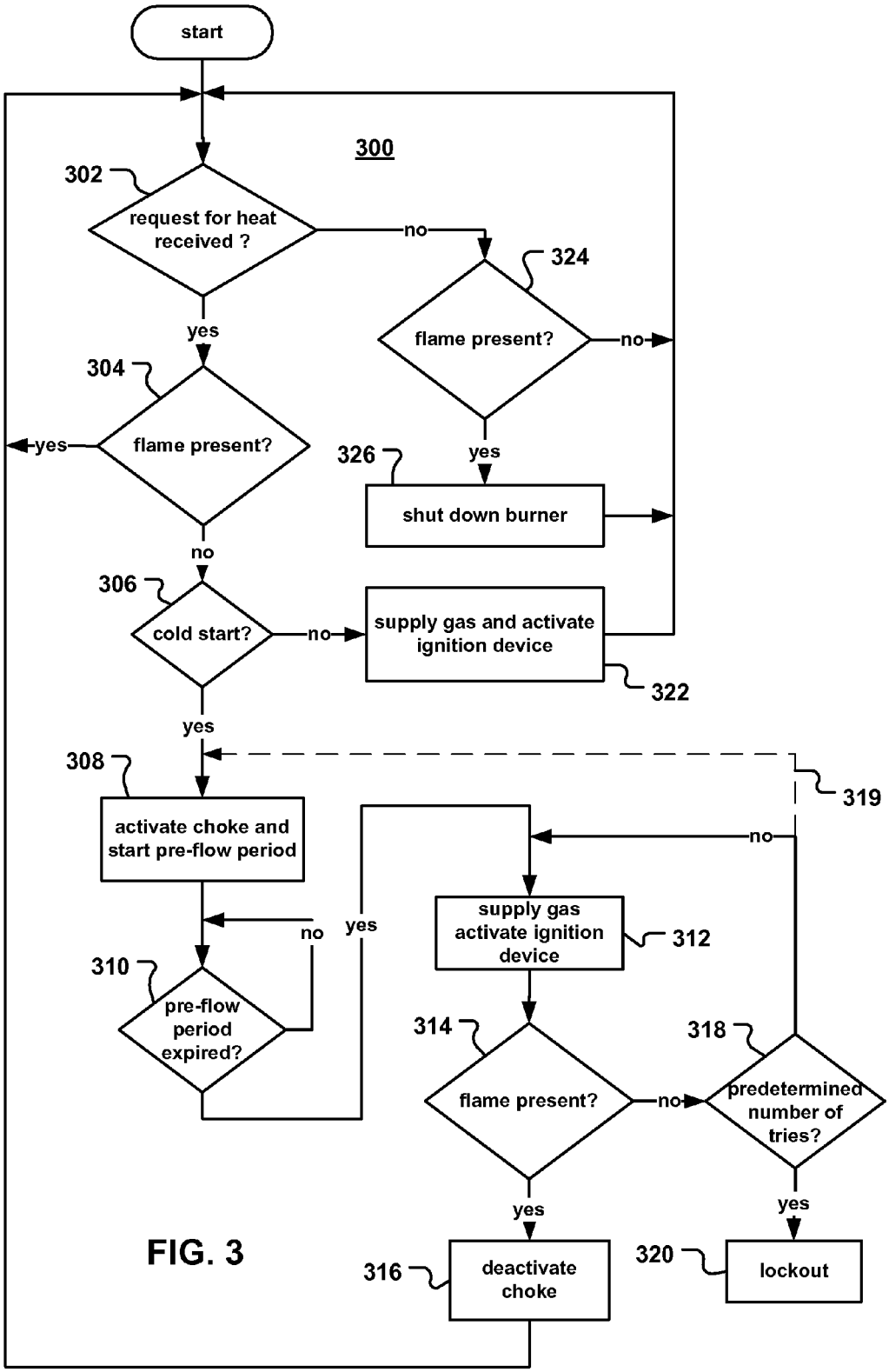
FIG. 3 is a process flow diagram of igniting a burner in accordance with an exemplary embodiment.

FIG. 3 is a process flow diagram of an exemplary method 300 of igniting a burner unit in either a cold start or normal ignition condition according to some embodiments. For example, the method 300 can be used in the burner systems shown in FIGS. 1 and 2. Method 300 starts at decision 302 where a request for heat is received from a thermostat and/or a manual switch. The manual switch can be an on/off switch that provides power to components of a burner system including the burner unit, and can also initiate either a standby low heat mode or any heat mode set by the thermostat.

If a request for heat is received, the "yes" path is taken to decision 304, which determines whether a flame is present at the burner surface, for example, by determining whether a current is present in a circuit including a flame sensor provided at the burner unit. If a flame is present, the burner unit must be operating and the "yes" path is taken to decision 302, which continuously monitors whether a request for heat is present.

When decision 304 determines no flame is present at the burner while a request for heat is pending, method 300 proceeds to decision 306 which determines whether a cold start condition exists. For example, an embodiment may sense a temperature from the area of the burner to indicate that the temperature of the burner unit meets a threshold that would allow the burner unit to uniformly ignite using an air/gas mixture having a standard combustion ratio. Alternatively, a temperature reading that does not meet a threshold can indicate that the temperature of the burner is in a cold start condition where the burner should be ignited while activating an air intake choke for the duration of a pre-flow period.

If decision 306 determines a cold start condition exists, the "yes" path is taken from decision 306 to process 308, which activates the choke and starts the pre-flow period. The duration of the pre-flow time period can be determined using a timer, which ranges from about 4 to 12 seconds, and the duration can depend upon the size of the burner body being filled and/or the type of fuel gas being used. For example, combustible gases having a high heating value per unit volume relative to natural gas, such as butane, are more difficult to light and carry the flame over the entire surface of the burner during a first attempt at ignition when the burner is cold compared with other gases such as propane or natural gas. The duration of a pre-flow period can be defined using a timer that is activated after turning on an on/off switch while the burner is in a cold start condition, although a pre-flow time period can be generated or tracked in other ways. For example, in an embodiment in which a request for heat initiates activation of a blower, the controller can sense that the blower is functioning if a vacuum switch in the blower indicates the blower is actually on. When the signal from the vacuum switch is received, the controller can start a pre-purge time, which is a purge of anything left in the burner and fuel supply channels, by turning on the blower to allow air to flow for a predetermined amount of time. The purge time can vary for different applications, but a typical predetermined pre-flow period would be about 5 seconds.

The operation of the choke can be implemented using a timer that is associated with the ignition control, for example, a timer integrated in an ignition module. Alternatively, some embodiments can include a timer for controlling activation and deactivation of the choke, which is dedicated to the choke or a timer that operates independently from a timer that controls another ignition element (e.g., a timer for tracking a pre-flow time period). For example, the choke can be activated to restrict incoming air for all or part of an ignition process time period by using a timer that is dedicated to the choke, or by using a timer associated with the choke that operates independently from one or more other timers that control one or more other ignition elements. Such a timer can be started, for example, by turning on an ignition or off/on switch of a device containing the burner unit, or in response to initiation of another burner unit ignition process, and the choke can remain activated for a predetermined period of time that is tracked by the timer.

At the end of the pre-purge time, at process 312, the controller opens the gas valve to allow the gas to flow and starts the igniter at the same time. If a flame is detected at process 314, the controller can deactivate the choke at process 316, although the choke may be deactivated in another way, such as in correspondence the passing of a predetermined amount of activation time independently tracked by a timer, as described above. In one embodiment, the entire time starting from the pre-flow timer to the time the choke is deactivated can be about 12.5 seconds, although the time to ignition of the flame can vary depending on the particular application.

Next, the air is allowed to flow for the entire pre-flow period, as shown by decision 310. After the pre-flow period expires, the "yes" path is taken from decision 310 to process 312, which activates an ignition device to light the rich air/gas mixture exiting the burner. Instead of activating the choke around the start of the pre-flow period at process 308, the choke can be activated in process 312 or at any point in time between decision 306 and process 312.

Next, decision 314 determines whether a flame is present to confirm that the burner has successfully ignited. If a flame is present, the "yes" path is taken to process 316, which deactivates the choke to allow a desired air and gas mixture for efficient combustion and heating requirements. The method then returns to decision 302, which continues to monitor whether a heat request is pending, for example, from the thermostat.

If the burner fails to ignite during process 312, a flame will not be detected in decision 314 and the "no" path is taken from decision 314 to decision 318, which determines whether a predetermined number of attempts have been made to light the burner. If not, ignition of the burner is attempted repeatedly until either a flame is detected or a maximum number of unsuccessful attempts have been made to ignite the burner, or if ignition is unsuccessful after elapse of a predetermined ignition time period. Repeated attempts can be performed by returning to process 312, or optionally to process 308 if a purge of the system is desired, as shown by dashed line 319.

If the maximum number of unsuccessful attempts is reached or the ignition time period times out, process 320 initiates a lockout. In lockout, process 320 can involve shutting down the burner and/or appliance including the burner, including turning off a gas valve supplying the gas and displaying an error code on a display associated with the burner and/or controller.

If decision 306 determines that the condition at the burner is not a cold start, method 300 proceeds to process 322, which represents a typical ignition process including supplying an air/gas mixture and igniting the mixture without activating a choke or performing a pre-flow period. While not shown, a lockout procedure including processes such as 314, 318 and 320 can be performed if the process 322 fails to light the burner. If decision 302 indicates no request for heat is pending, the "no" path from decision 302 to decision 324, which determines whether a flame is present at the burner. This can be a situation in which the cooking area or other area to be heated reaches the value set by the thermostat or that heat generation by the burner is otherwise no longer needed. If a flame is present, the burner is shut down by closing the gas valve and any other fuel system element, such as a blower, to extinguish the burner. After turning off the burner, the method 300 proceeds to decision 302 to monitor for any status change (i.e., the presence of a request for heat).

Figure 4B:
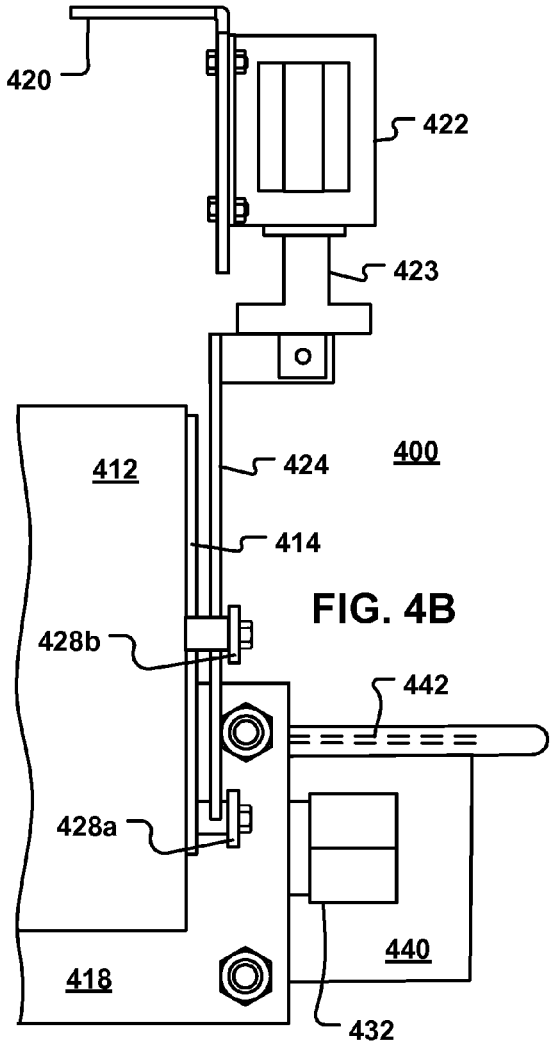
FIG. 4B is an end view of a portion of the infrared burner assembly shown in FIG. 1A.
Figure 4A:
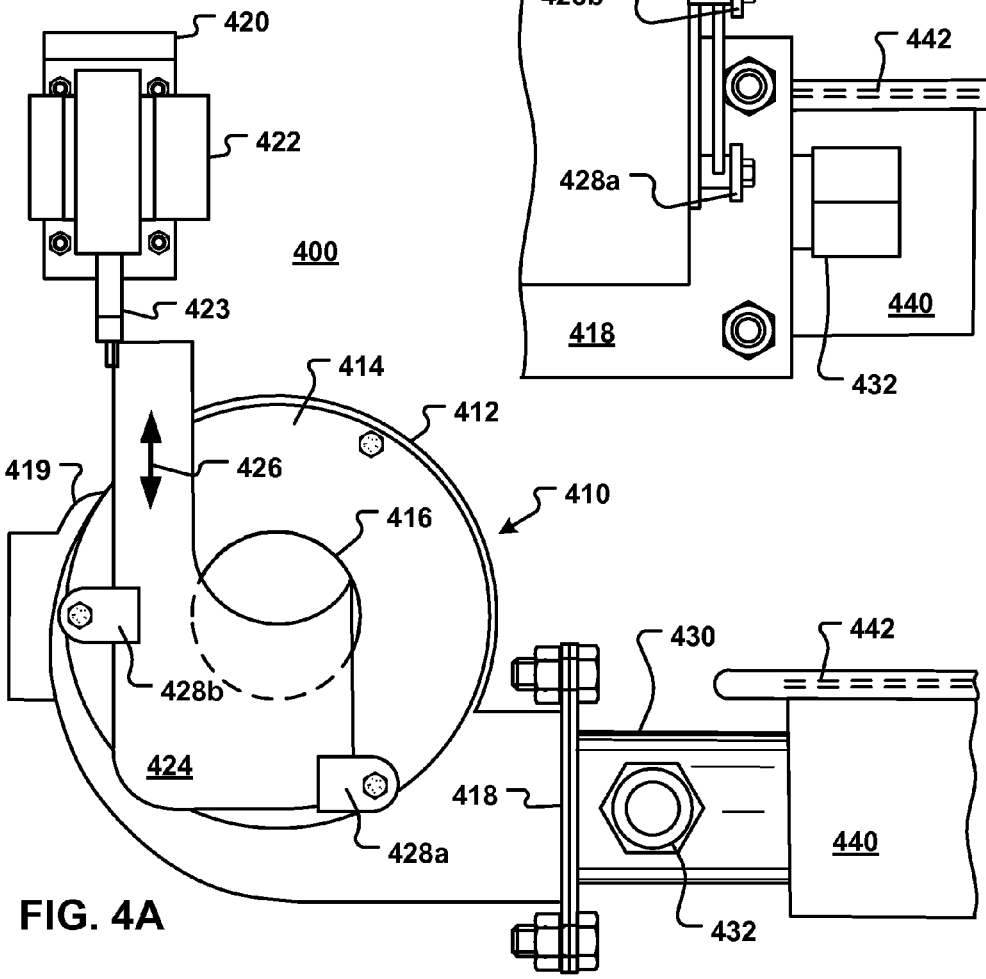
FIG. 4A is a side view of an infrared burner assembly in accordance with an exemplary embodiment.

FIGS. 4A and 4B respectively depict side and front views of a powered burner 400 including a choke in accordance with exemplary embodiments. The powered burner 400 can be used in a burner system in which a powered blower forces air into a mixing chamber where gas is supplied to mix the air and gas before providing the air/gas mixture to a burner unit, such as the burner system 200 described herein with respect to FIG. 2. The powered burner 400 includes a blower body 410 can include a housing 412, an access plate 414 having an intake opening, or port, 416, an outlet end at a mating flange 418, and a blower motor 419. Although not shown, the blower body 410 includes a fan, such as a squirrel cage fan, which is powered by the blower motor 419 to draw air into the intake opening 416.

The powered burner 400 includes an ignition choke assembly that comprises a solenoid 422 with a plunger 423, a choke plate 424 connected to the solenoid plunger 423. The choke plate 424 includes a flat portion that can slide in the directions indicated by arrows 426 to partially cover the intake port 416 when the solenoid 422 is energized. The choke plate 424 is guided by tabs 428*a* and 428*b* positioned on opposite sides of plate 414, which allow the choke plate 424 to move in the vertical direction, but restrain movement in a horizontal direction. It is to be understood that although the terms "horizontal" and "vertical" are used above to describe the orientation of FIGS. 4A and 4B, other embodiments can include a burner, and thus also a choke plate, in any desired orientation. Further, a choke can comprise more than one portion or be incorporated into another part of the intake, such as adjustable vanes of a swirl plate at the blower intake. Additionally, an actuator other than a solenoid can be used to move the choke plate 424 or other choke mechanism to a predetermined position to restrict an amount of air entering the intake of the blower.

The outlet end 418 end of the powered burner 400 can be connected to a mixing tube 430 of a burner assembly including a burner manifold (box or base) 440. A porous tile or plate material 442 is provided on the burner manifold 440. The mixing tube 430 includes a gas supply inlet 432 through which is supplied a gas source, such as natural gas, propane, or butane. As the fan of the blower body 410 blows air into the mixing tube 430, the gas supplied from the gas supply inlet 432 mixes with the gas and enters into the burner manifold 440. In some embodiments, the burner unit can include an infrared type burner including one or plural ceramic plate 442 including an array of pores through which the air/gas mixture exits the burner manifold 440 and is burned at the surface thereof, although another burner material such as steel mesh or a refractory metal can also be used instead of a ceramic material.

Figure 5A:
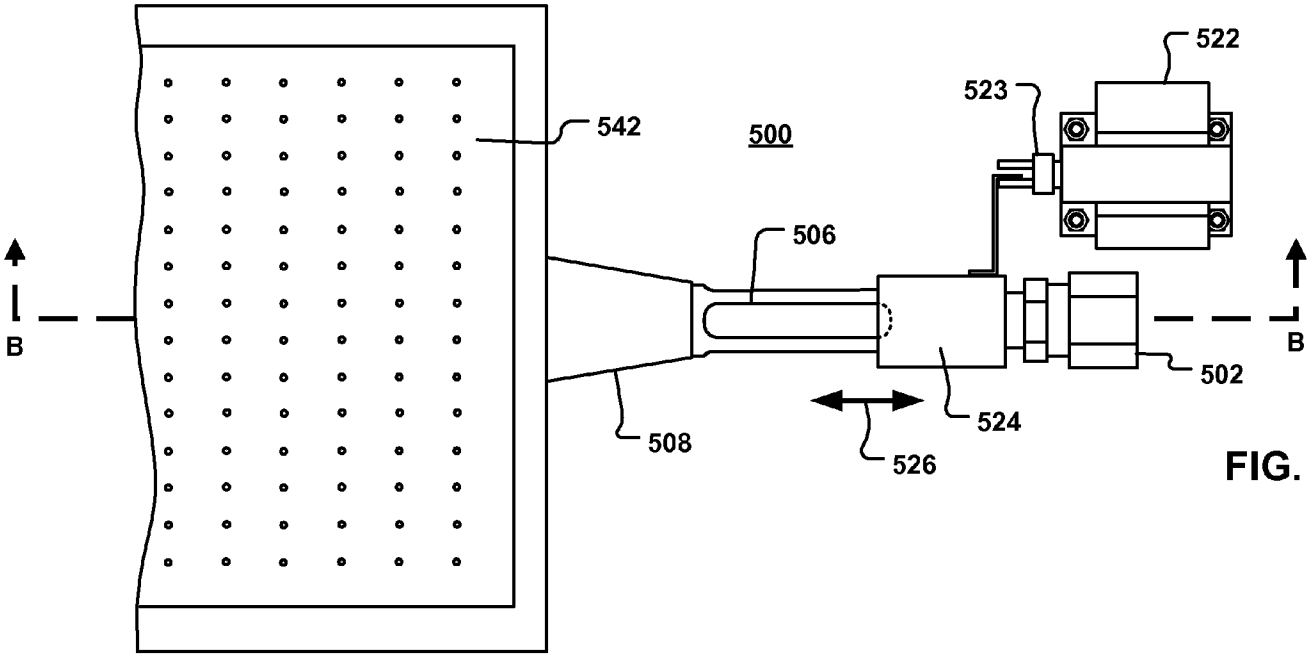
FIG. 5A is a plan view of a portion of an infrared burner assembly in accordance with an exemplary embodiment.
Figure 5B:
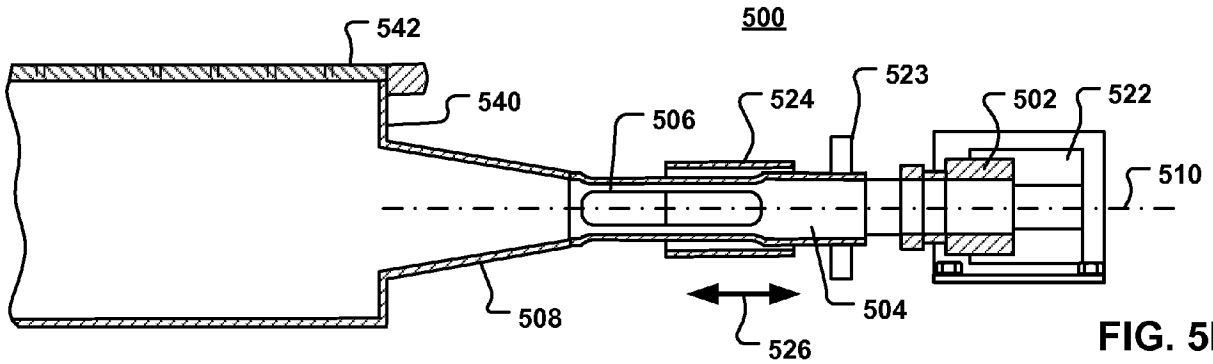
FIG. 5B is a cross-sectional side view of the infrared burner assembly shown in FIG. 2A taken along line B-B.

FIGS. 5A and 5B respectively show top and side views of an inspirator, (i.e., atmospheric) type burner 500 according to some embodiments. The inspirator type burner 500 can be used in a burner system, such as the burner system 100 described herein with respect to FIG. 1, which supplies gas under pressure through an orifice or nozzle and draws oxygen at atmospheric pressure into a mixing chamber by the momentum of the gas. The burner 500 includes a fuel supply having an inlet 502 through which a flammable gas is introduced under pressure, a channel 504, one or more air intake ports 506, and a mixing portion 508. As the gas travels past the air intake ports 506, air is drawn in and mixes in the mixing portion 508 with the supplied gas. As shown in FIGS. 5A and 5B, the mixing portion 508 can have a tapered or other expanding shape along the longitudinal axis 510 of the fuel supply to promote mixing of the gas and air before the air/gas mixture enters a burner manifold 540. The air/gas mixture exits a porous tile or plate material 542 provided on the burner manifold 540, such as a porous ceramic tile material, where it is burned while a request for heat is present.

The burner 500 includes an air intake choke, which includes a solenoid 522 having a plunger 523 connected to a collar 524 surrounding a portion of the fuel supply. As described above, the intake choke can be activated momentarily during a cold start ignition process by activating the solenoid 522 to move the collar 524 to partially cover the air intake ports 506 during an ignition process, for example, during a short pre-flow period in which gas and air are provided before attempting ignition. For example, activation of the collar 524 can move the collar in a first direction along arrows 526 (i.e., in a direction along longitudinal axis 510) into one or more positions to partially block the intake ports 506. For example, FIG. 5B shows the solenoid 523 in the activated position, where the collar 524 has been moved to extend over a substantial portion of the total opening area of the air intake ports 506 and restrict the amount of air entering and mixing with the gas in the mixing portion 508. It is to be understood that a position to which the collar 524 is moved during activation can be a single position for each activation or one of plural possible positions whose selection is based on one or more of the type of gas used, a temperature of the burner, the temperature of the air to be inducted by an intake port, or some other criterion. After the pre-flow period expires or a flame is sensed at the burner surface, the solenoid plunger 523 retracts and moves the collar 524 in a second direction opposite the first direction to uncover a greater portion or all of the air intake ports 506, for example, as shown in FIG. 5A.

It will be appreciated that the embodiments described and shown herein may be modified in a number of ways. For instance, although the exemplary embodiments described above include a solenoid that moves a choke plate or choke collar to momentarily restrict the intake of air, another kind of actuator can be used. Further, while a choke in the embodiments described above move along a longitudinal axis of a fuel supply or in some other linear way to cover and uncover a portion of an air intake, it will be appreciated that other applications can include a choke that moves in another way, such as rotationally, for example. Further, while the pre-flow period described above with respect to processes 308 and 310 provides a level of safety when igniting the burner, it is not necessary to perform the pre-flow period. For example, processes 308, 310 and 312 can be replaced with a process which activates the choke, opens the gas supply, and activates the ignition device simultaneously or at about the same time. Such alternative ignition process can be used in either a forced air type burner (i.e., powered burner with a blower) or an atmospheric (i.e., inspirator) type burner.

Thus, while a limited number of embodiments are described herein, one of ordinary skill in the art will readily recognize that there could be variations to any of these embodiments and those variations would be within the scope of the appended claims. Accordingly, it will be apparent to those skilled in the art that various changes and modifications can be made to the burner and ignition assembly described herein without departing from the scope of the appended claims and their equivalents.

What is claimed is:

1. A burner assembly, comprising:

a burner unit;

a fuel supply attached to the burner unit and including a gas valve, an air intake, and a mixing portion in which gas and air are mixed;

a choke movable relative to the air intake to adjust an amount of air entering into the air intake port; and an electronic controller to control the movement of the choke relative to the air intake, wherein the controlled movement includes momentarily moving said choke from a first position prior to activation by said electronic controller to a second position that reduces an amount of air entering the intake for a momentary pre-flow period when a cold start condition exists.

2. The assembly of claim 1, wherein the electronic controller determines a cold start condition exists based on at least one of sensing a temperature of the burner and sensing that power to the burner assembly has been turned on.

3. The assembly of claim 1, wherein air is drawn in the air intake by gas passing through the fuel supply.

4. The assembly of claim 3, wherein said choke comprises a collar surrounding a portion of the fuel supply.

5. The assembly of claim 1, further comprising a blower, wherein gas is drawn from the gas valve into the mixing portion by air from the intake being blown in by the blower.

6. The assembly of claim 5, wherein the air intake is an opening formed in a substantially flat surface of the blower and the choke comprises a substantially flat moveable plate that covers a substantial portion of the intake when moved into the air restricting position.

7. The assembly of claim 5, further comprising an ignition device positioned at a surface of the burner, wherein the electronic controller prevents the ignition device from activating and the gas valve from opening until after the blower has blown air for a predetermined period of time.

8. The assembly of claim 1, further comprising a flame sensor proximate a surface of the burner unit, wherein the electronic controller deactivates the choke if the flame sensor detects a flame.

9. The assembly of claim 1, wherein the burner comprises at least one porous ceramic plate.

10. A method of igniting a burner, comprising:

monitoring for presence of a request for heat, wherein said request for heat is generated by a thermostat or a power on/off switch;

determining if a cold start condition exists when a request for heat is present;

activating a choke that moves relative to an air intake of the burner to restrict an amount of intake air entering the intake and supplying gas to the burner if a cold start condition exists, wherein the activated choke is momentarily moved from a first position prior to the choke activation to a second position to provide a substantially uniform distribution of flame at a surface of the burner after ignition;

activating an ignition device to light the burner, wherein the ignition activation is delayed for a momentary pre-flow period if a cold start condition exists to provide a substantially uniform distribution of flame at a surface of the burner after ignition; and deactivating the choke after successful ignition of the burner, wherein the deactivated choke is actively positioned to provide an efficient air-fuel mixture.

11. The method of claim 10, wherein determining if a cold start condition exists comprises sensing the temperature at the burner, and determining whether the sensed temperature meets a predetermined threshold amount.

12. The method of claim 10, wherein determining if a cold start condition exists comprises sensing whether that power to the burner has been turned on.

13. The method of claim 10, wherein activating the choke comprises moving a planar plate to cover a substantial portion of an air intake of the burner.

14. The method of claim 10, wherein activating the choke comprises moving a collar surrounding an air intake of the burner to cover over a substantial portion of the air intake.

15. The method of claim 10, further comprising supplying air to the burner with a blower for a predetermined momentary pre-flow time period, and delaying supplying the gas and activating the ignition until the pre-flow time period has expired.

16. The method of claim 15, wherein initiation of supplying the gas and activating the ignition are performed simultaneously.

17. The method of claim 10, wherein said activated choke positioning is determined by one or more of the factors in the group comprised of fuel type, burner type, desired burner temperature, heat detected at one or more burners, flame detection at one or more burners, turning the power switch on, and the passage of a predetermined period of time.

18. The method of claim 10, wherein said deactivated choke positioning is determined by one or more of the factors in the group comprised of fuel type, burner type, desired burner temperature, heat detected at one or more burners, flame detection at one or more burners, the passage of a predetermined period of time after choke activation, the passage of a predetermined period of time after gas supply initiation, and the passage of a predetermined period of time after ignition.

* * * * *